US005393941A

United States Patent [19]

Mizuno et al.

[11] Patent Number: 5,393,941

[45] Date of Patent: Feb. 28, 1995

[54] CONTROLLER FOR ROPELESS ELEVATOR

[75] Inventors: Masamoto Mizuno; Toshiaki Ishii, both of Inazawa, Japan

[73] Assignee: Mitsubishi Denki Kabushiki Kaisha, Tokyo, Japan

[21] Appl. No.: 80,621

[22] Filed: Jun. 22, 1993

[30] Foreign Application Priority Data

Jun. 23, 1992 [JP] Japan ..... 4-164745

[51] Int. Cl.[6] ..... B66B 1/06; B66B 3/02

[52] U.S. Cl. ..... 187/293; 187/394

[58] Field of Search ..... 187/116, 117, 134, 133, 187/130, 112; 246/8

[56] References Cited

U.S. PATENT DOCUMENTS

| | | | |
|---|---|---|---|
| 3,601,227 | 8/1971 | Birch | 187/29 R |
| 3,904,941 | 9/1975 | Matsui et al. | 318/135 |
| 3,979,091 | 9/1976 | Gagnon et al. | 246/8 |
| 4,083,430 | 4/1978 | Gingrich | 187/29 R |
| 4,341,287 | 7/1982 | Kuzunuki et al. | 187/29 R |
| 4,387,436 | 6/1983 | Katayama et al. | 364/561 |
| 4,603,640 | 8/1986 | Miller et al. | 104/828 |
| 5,070,967 | 12/1991 | Katzy et al. | 187/116 |
| 5,158,156 | 10/1992 | Okuma et al. . | |
| 5,183,980 | 2/1993 | Okuma et al. . | |
| 5,235,144 | 8/1993 | Matsui et al. | 187/112 |

FOREIGN PATENT DOCUMENTS 323171 1/1991 Japan .

*Primary Examiner*—Steven L. Stephan
*Assistant Examiner*—Robert Nappi
*Attorney, Agent, or Firm*—Leydig, Voit & Mayer

[57] ABSTRACT

A controller for a ropeless elevator, includes: a cross induction line cable arranged along the hoistway; an exciter provided on the car side to generate sinusoidal waves for positional detection in the cable; a movement amount detector provided on the car side to detect a car movement amount; a data calculator provided on the car side to calculate data on car speed and on secondary-conductor magnetic pole phase from the movement amount detected by the movement amount detector; a data transmitter provided on the car side to utilize the cross induction line cable in transmitting the data calculated by the data calculator to the building side; an induction radio circuit provided on the building side to utilize the cable in receiving data from the data transmission device and calculate the initial phase of the secondary conductor from the sinusoidal waves generated in the cross induction line cable; and an inverter control circuit provided on the building side to interpolate the initial phase calculated by the induction radio circuit on the basis of the magnetic pole phase received by the induction radio circuit and control the inverter on the basis of the calculated car position and the car speed data received by the induction radio circuit.

7 Claims, 9 Drawing Sheets

CONTROLLER FOR ROPELESS ELEVATOR

BACKGROUND OF THE INVENTION

1. Field of the Invention

This invention relates to a controller for a ropeless elevator using a linear motor and, in particular, to a controller which utilizes inductive radio to transmit the position, speed, etc. of the car to a control circuit on the building side, thereby controlling the linear motor.

2. Description of the Related Art

FIG. 4 schematically shows a conventional elevator system. In the drawing, numeral 1 indicates an elevator hoisting machine; numeral 2 indicates a deflector wheel for shifting the elevator rope position; numeral 3 indicates a car/counterweight suspending rope; numeral 4 indicates a car rail for guiding an elevator car 5; and numeral 6 indicates a couterweight rail for guiding a counter weight 7.

This conventional elevator system, constructed as described above, requires the rope 3 for suspending the car 5, so that the system is suitable for a skyscraper having a height, for example, of 1000 m or more, due to the weight of the rope, etc. As a means for solving this problem in the conventional elevator system, a ropeless elevator driven by a linear motor has been disclosed, for example, in Japanese Patent Laid-Open No. 3-23171.

FIG. 5 shows the construction of a ropeless elevator as disclosed in the above-mentioned laid-open publication. In the drawing, numeral 5 indicates an elevator car; numeral 8 indicates a linear motor field formed by a permanent magnet, superconductive coil or the like; numeral 9 indicates linear-motor armature coils provided on the building side; and numeral 10 indicates armature yokes. The armature coils 9 and the yokes 10 are arranged on either side of the elevator so as to guide the elevator car 5 along an elevator hoistway 11. Numeral 12 indicates a guide rail for supporting the elevator, and numeral 13 indicates an upper buffer.

FIG. 6 shows the principle of a ground-primary-type linear motor, which is used in the elevator shown in FIG. 5. Referring to FIG. 6, when three-phase alternating currents are passed through the armature coils 9, arranged on the building side to face the linear motor field 8 on the elevator-car side, in such a way as to generate a progressive magnetic field 8A having a polarity attracting the field and corresponding to the load, a thrust B.L.I (B: magnetic flux density; L: current-side length; I: current), as is clarified in electromagnetics.

FIG. 7 shows a feed control block diagram for the above armature coils 9. The armature coils 9 of FIG. 5 are shown as consisting of armature coils 91L through 94L and 91R through 94R, of which the armature coils 91L, 92L, 93L and 94L are arranged on the left-hand side, and the armature coils 91R, 92R, 93R and 94R are arranged on the right-hand side. The armature coils 91L, 91R, 93L and 93R are fed by an inverter **14*a* through change-over switches 21 and 23 so as to be excited. The armature coils 92L, 92R, 94L and 94R are fed by an inverter 14*b* through change-over switches 22 and 24** so as to be excited.

When the elevator car 5 is at a position where it faces the armature coils 91L and 91R, the change-over switch 21 is closed, so that the armature coils 91L and 91R are excited by the inverter **14*a*. The elevator is driven by the interaction of the current in the excited armature coils and the field 8 attached to the elevator car 5. When the elevator car 5 descends from the position of the armature coils 91L and 91R to that of the armature coils 92L and 92R, the armature coils 91L and 91R are excited by the inverter 14*a*, and the armature coils 92L and 92R are excited by the inverter 14*b*. In this process, the change-over switches 21 and 22** are both in the closed position.

When the elevator car 5 has completely moved to the position of the armature coils 92L and 92R, only the change-over switch 22 is in the closed position to excite the armature coils 92L and 92R. Similarly, as the elevator car moves on, the change-over switch 23 is closed to excite the armature coils 93L and 93R, and then the change-over switch 24 is closed to excite the armature coils 94L and 94R. In this way, the elevator car is caused to descend. When causing the elevator car to ascend, the armature coils 9 are successively excited by a sequence reverse to the above-described one.

A control system for a ropeless elevator of the above-described type, in which the elevator car 5 is caused to move by successive excitation of the armature coils 9 provided on the building side, has not been generally established yet. In a linear motor car, which is propelled by the same principle as described above, the position and speed of the car are detected by utilizing cross induction lines because of the high speed of the car. An elevator control system using this method will be described with reference to FIGS. 8 and 9.

Referring to FIG. 8, numeral 40 indicates a cross induction line cable provided in the hoistway of the elevator. The cable includes position detecting line pairs (G1-A, G1-B, G2, , Gn) 41~44, data transmission line pairs (D1, D2) 45, 46, and a signal level reference line pair (C) 47. Numerals 57 and 84 respectively indicate an induction radio antenna and an oscillator which are mounted on the elevator car 5.

In the construction shown in FIG. 8, the induction radio antenna 57, mounted on the elevator car 5, is excited by the oscillator 84, thereby inducing an electromotive force in each induction line in the cross induction line cable 40 provided in the elevator hoistway, which faces the antenna 57. As illustrated in FIG. 9, this electromotive force has a pseudo-sinusoidal wave in which the electric potential where the induction lines intersect each other is 0 V.

Accordingly, the induction lines (G1-A and G1-B) 41 and 42 of FIG. 8 are arranged with their intersections 90 degrees offset from each other, as shown in the drawing, so that, as shown in FIG. 9, the electromotive forces induced in the induction lines (G1-A) 41 and (G1-B) 42 are 90 degrees out of phase with respect to each other. Generally speaking, to increase noise margin, 1/0 judgment is made through checking with reference to the sign of the signal level reference pair 47.

The cross induction line cable 40 generally contains a plurality of induction lines 41~44 having predetermined codes so as to effect detection of absolute positions, and the accuracy in the detection of position and speed is enhanced through interpolation of the analog values of the pseudo sinusoidal waves of the induction lines. The speed detection has been effected through calculation from positional variation in a predetermined time.

Further, by utilizing induction radio, it is possible to effect variation in positional detection and carrier frequency, thereby making it possible to perform ordinary data communication; by means of the induction lines for data communication (D1) 46 and (D2) 45, communication between the movable body and the ground has been conducted. Since communication is impossible at intersections, two induction lines having their intersections 90 degrees offset, are usually used, as in the case of the communication lines (D1) 46 and (D2) 45.

However, the above-described conventional system for detecting the position and speed of the movable body, which utilizes induction radio, solely utilizes cross induction lines, so that the accuracy in position and speed is determined by the intersection lengths of the cross induction lines. Thus, generally speaking, there is a limit to the enhancement of the minimum detection accuracy even when the analog values of the pseudo-sinusoidal waves of the induction lines are interpolated. Thus, although this system has not involved any problems in the case of railroads, travelling cranes, etc., which have a very large inertia, it has been unsatisfactory in terms of accuracy for uses where the inertia is relatively low and where vibrations, etc. constitute a problem, as in the case of an elevator.

SUMMARY OF THE INVENTION

This invention has been made with a view toward eliminating the problems in the prior art as described above. It is the object of this invention to provide a ropeless elevator controller which is capable of controlling a ropeless elevator with high accuracy.

In accordance with this invention, there is provided a ropeless elevator controller for a ropeless elevator of the type in which a plurality of primary windings are arranged in an elevator hoistway on the building side and in which a secondary conductor is provided on the car side, the car being caused to ascend or descend by generating a shifting magnetic field in the primary windings through an inverter, the ropeless elevator controller comprising:

- a cross induction line cable arranged along the elevator hoistway on the building side;
- excitation means which is provided on the car side and which generates sinusoidal waves for positional detection in the cross induction line cable;
- movement amount detecting means which is provided on the car side and which detects a movement amount of the car;
- data calculating means which is provided on the car side and which calculates data on car speed and data on the magnetic pole phase of the secondary conductor on the basis of the movement amount detected by the movement amount detecting means;
- data transmission means which is provided on the car side and which utilizes the cross induction line cable to transmit the data calculated by the data calculating means to the building side;
- an induction radio circuit which is provided on the building side and which receives the data transmitted from the data transmission means by utilizing the cross induction line cable and calculates the initial phase of the secondary conductor provided on the car from the sinusoidal waves generated in the cross induction line cable; and
- an inverter control circuit which is provided on the building side and which interpolates the initial phase calculated by the induction radio circuit on the basis of the magnetic pole phase received by the induction radio circuit and controls the inverter on the basis of the calculated car position and the data on car speed received by the induction radio circuit.

DESCRIPTION OF THE PREFERRED EMBODIMENTS

Embodiments of this invention will now be described with reference to the accompanying drawings.

First Embodiment

Figure 1:
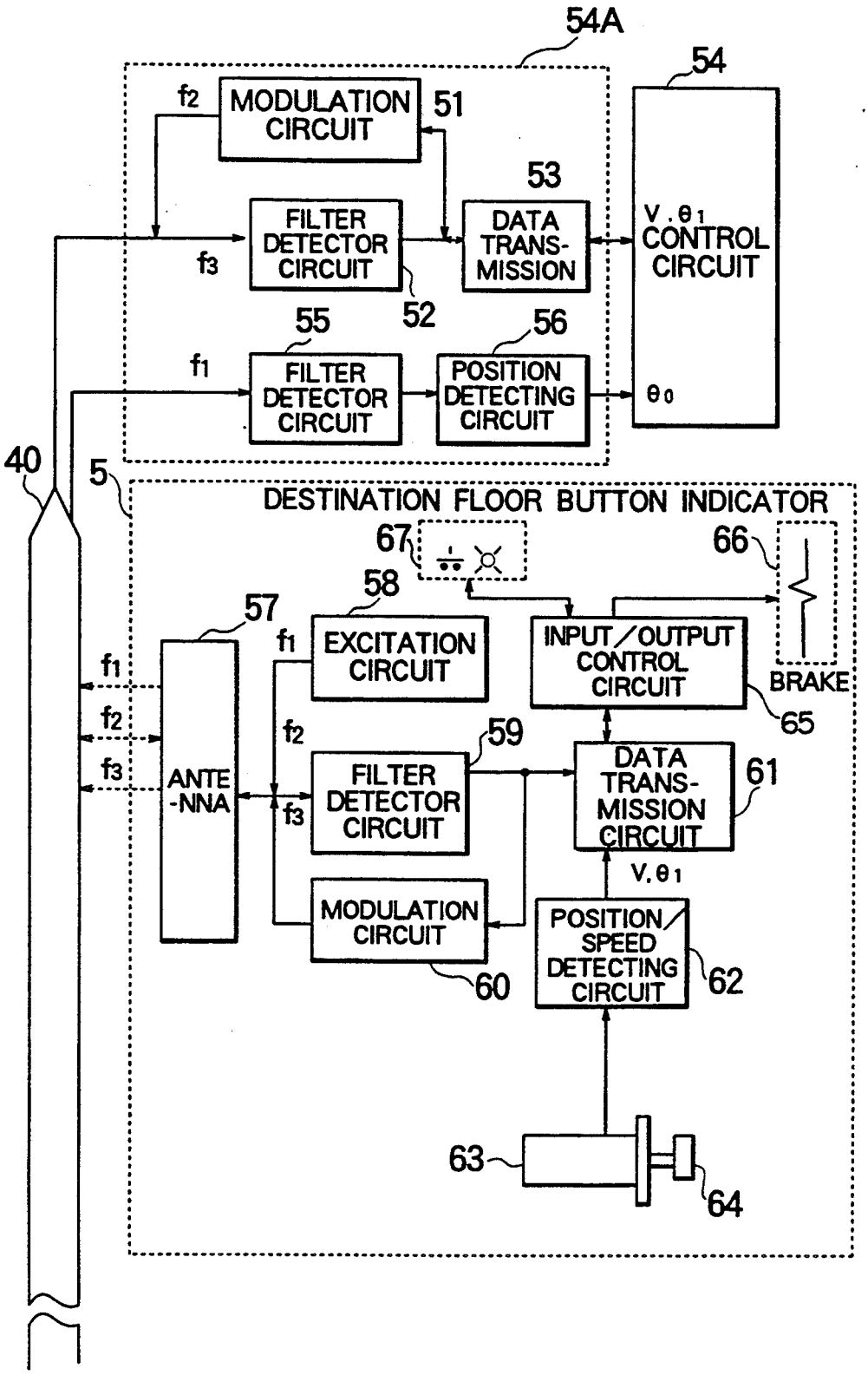
FIG. 1 is a block diagram showing a ropeless elevator controller according to a first embodiment of this invention.

Referring to FIG. 1, numeral 40 indicates a cross induction line cable arranged in the hoistway of the elevator. Numeral 51 indicates a modulation circuit for transmitting data from the building side to the elevator car 5; the carrier frequency, indicated at f2, usually undergoes FS (frequency shift). Numeral 52 indicates a band-pass filter and a detector circuit for transmitting data from the elevator car 5 to the building side.

Numeral 53 indicates a data transmission circuit for controlling the transmission and reception of data on the building side. Numeral 54 indicates a control circuit for an inverter for controlling the feed to the armature coils 9. Numeral 55 indicates a band pass filter and a detector circuit for positional detection on the building side. Numeral 56 indicates a position detecting circuit for performing position detection on the basis of a plurality of data from the cross induction line cable 40.

Numeral 57 indicates an induction radio antenna provided on the elevator car 5. Numeral 58 indicates an excitation circuit for positional detection provided on the elevator car 5 and having a modulation frequency of f1. Numeral 59 indicates a band-pass filter and a detector circuit for data transmission provided on the elevator car 5. Numeral 60 indicates a modulation circuit for transmitting data from the elevator car 5 to the building side, the carrier frequency of this modulation circuit is f3. Numeral 61 indicates a data transmission circuit for controlling the transmission and reception of data on the side of the elevator car 5.

Numeral 62 indicates a position/speed detecting circuit for detecting position (phase of the field pole) $\theta$ 1 and speed v on the basis of a row of pulses from an encoder 63, to which a roller 64 is attached. By bringing the roller 64 into contact with the rail of the hoistway, the encoder is rotated. Numeral 65 indicates an onboard input/output control circuit on the side of the elevator car 5, which is used as a destination floor button indicator 67 or as an input/output control circuit for a brake 66.

Figure 2:
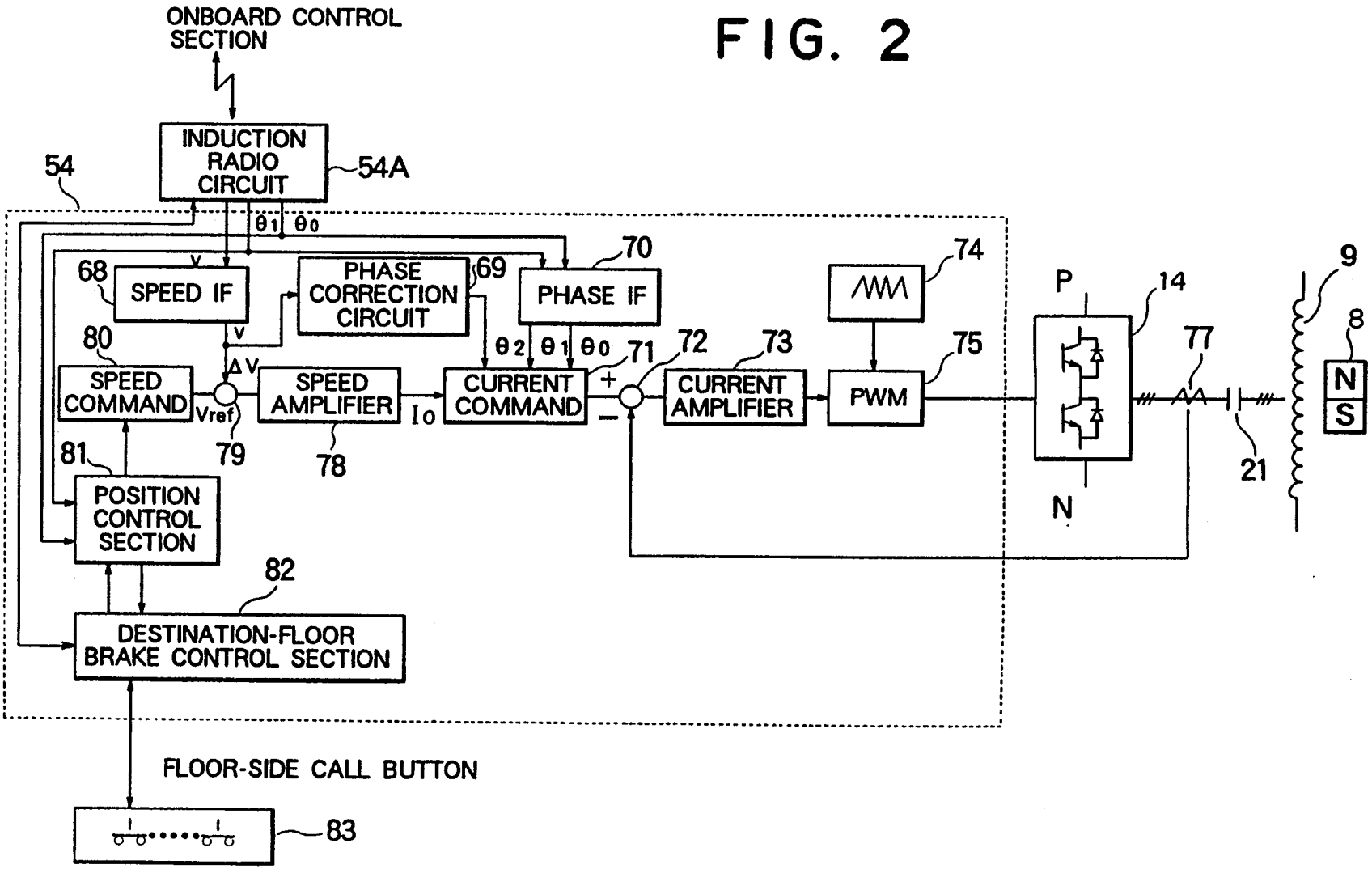
FIG. 2 is a block diagram showing the construction of the control circuit of the first embodiment.

FIG. 2 shows a block diagram of the control circuit 54 for one block of the inverter 14 for controlling the armature coils 9 on the building side of a ropeless elevator utilizing induction radio. Numeral 54A indicates an induction radio apparatus including the cross induction line cable 40, the modulation circuit 51, the filter/detector circuit 52, the data transmission circuit 53, the filter/detector circuit 55, and the position detecting circuit 56 which are shown in FIG. 1. Referring to FIG. 2, numeral 68 indicates a speed interface for inputting transfer data on the elevator speed detected and calculated on the side of the elevator car 5, through the cross induction line cable 40. Numeral 69 indicates a phase correction circuit for phase correction necessitated by any delay in elevator position detection and any delay in transmission to the building side detected on the side of the elevator car 5. Numeral 70 indicates a phase interface for receiving transfer data on the phase of the field attached to the elevator, detected and calculated on the side of the elevator car 5, through the cross induction cable 40.

Numeral 71 indicates a current command generation circuit for generating a current command for the armature. Numeral 72 indicates a subtracter circuit for calculating the deviation from the current command of the armature current as detected by a DC current transformer 77. Numeral 73 indicates a three-phase current amplifier for amplifying the current deviation. Numeral 74 indicates a chopping wave carrier oscillator for a PWM (pulse width modulation) circuit. Numeral 75 indicates the PWM circuit for performing feed control of the inverter 14 through checking of the current deviation and the chopping wave carrier.

Numeral 80 indicates a speed command circuit, numeral 81 indicates a position control section for calculating an amount of movement made by the car on its way to a destination floor, the remaining amount of movement to be made before its arrival at the destination floor, etc. Numeral 82 indicates a destination-floor brake control section which imparts a movement amount to the position control section 81 on the basis of information from a destination button provided on the car 5 and from a call button 83 on the floor side, and performs data transfer in such a way as to operate the brake on the elevator side when the remaining amount of movement has become 0. Numeral 78 indicates a speed amplifier for amplifying speed deviation. Numeral 79 indicates a checking circuit for calculating the deviation of the current speed from the speed command.

In the inverter control circuit 54, constructed as described above, three-phase currents Iu, Iv and Iw are controlled in the following manner by using the output of the speed amplifier 78 as a thrust command, i.e., a current command $I_0$, in order that the magnet of the field 8 provided on the car 5 may become perpendicular to the armature current:

$$Iu = I_0 \cdot \sin\theta$$

$$Iv = I_0 \cdot \sin(\theta - 2\pi/3)$$

$$Iw = I_0 \cdot \sin(\theta + 2\pi/3)$$

In the above formulae, $\theta = \theta_0 + \theta_1 + \theta_2$
where $\theta_0$: initial phase:

$\theta_1$: field pole phase varied as a result of a movement of the car 5;

$\theta_2$: corrected phase amount with respect to delay in phase detection and delay in data transmission.

Here, assuming that the current speed is v, and the total of detection delay time and transmission delay time is ts, the corrected phase amount $\theta_2$ is expressed as: $\theta_2 = v \cdot ts$. An attempt to detect the initial phase $\theta_0$ at the time of power turning ON, detector replacement, etc. on the side of the car 5 would necessitate a linear absolute value encoder or the like, which is not practical. Accordingly, the initial phase $\theta_0$ is detected by induction radio. Any error due to induction radio is compensated for by a fixed-position detector or the like (not shown) when, for example, the car has made a fixed-position stop at a predetermined floor.

Any error in the initial phase leads to a reduction in the thrust of the linear synchronization motor. However, since there is usually no load at the time of the power turning on, etc., such a reduction is negligible. An amount of movement when the elevator is in operation, i.e. a change in field pole phase, is detected by a high-precision detector on the side of the car 5, i.e., the excitation circuit for positional detection 58, and transmitted via the cross inducation cable 40 to the control circuit 54 on the building side.

Second Embodiment

Figure 3:
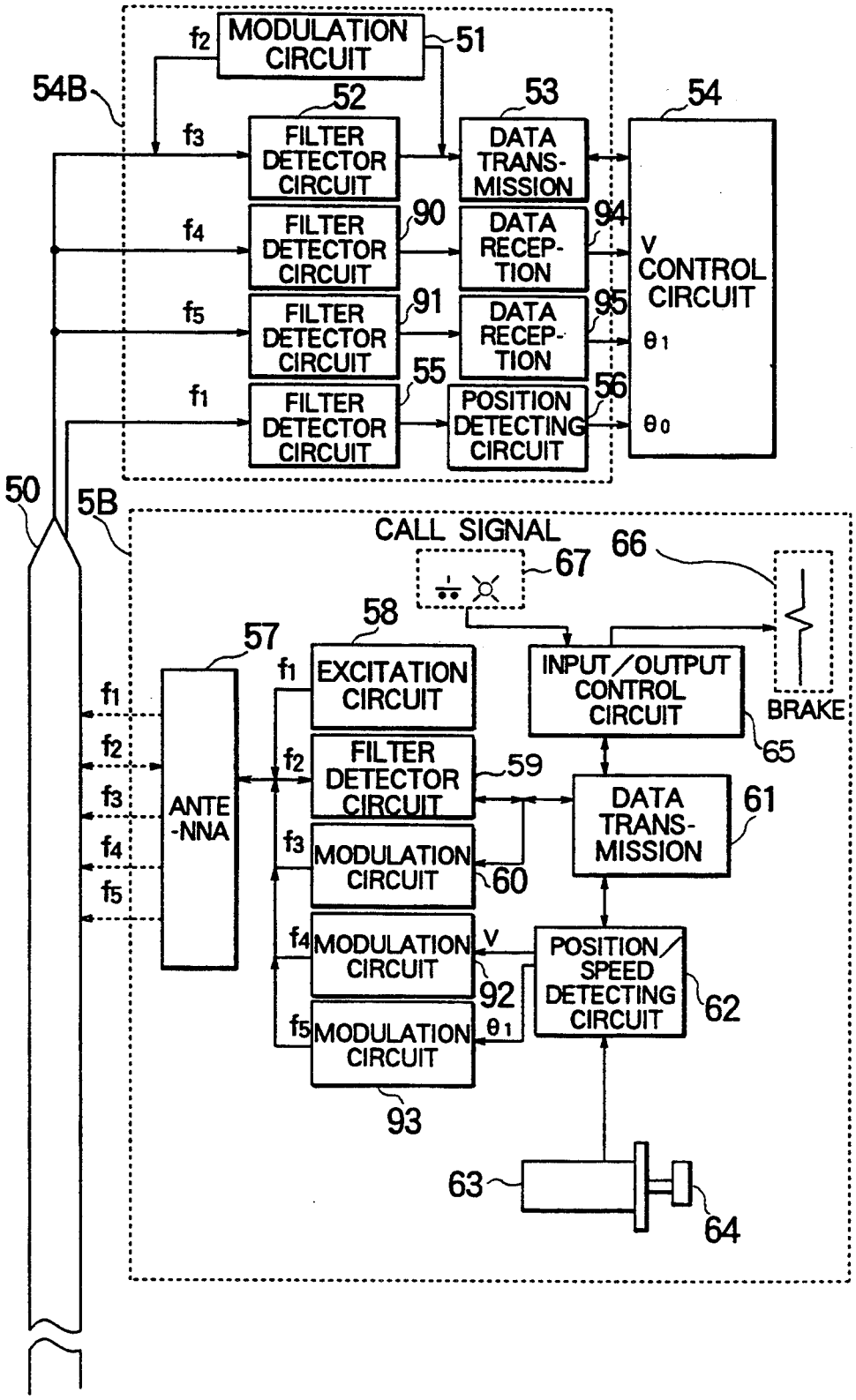
FIG. 3 is a block diagram showing a controller according to a second embodiment of this invention.
Figure 4:
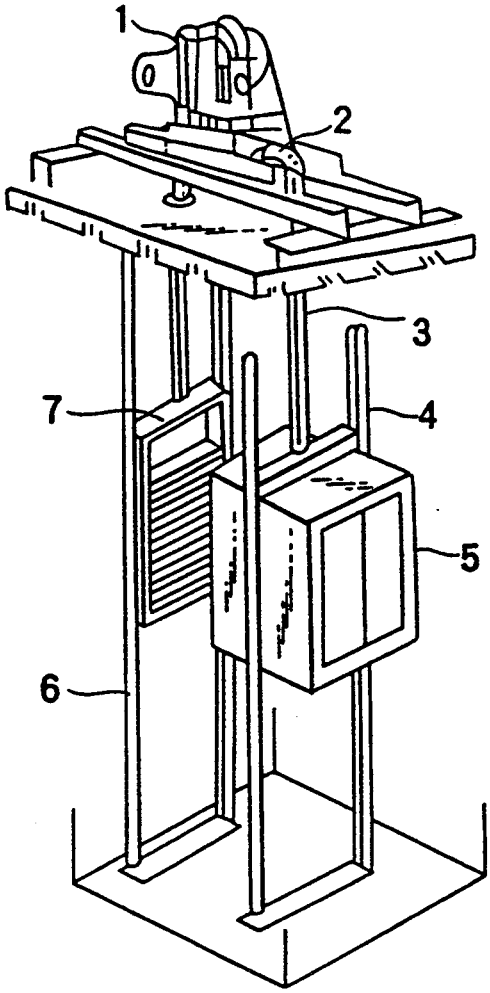
FIG. 4 PRIOR ART
FIG. 4 is a perspective view showing a conventional elevator apparatus.
Figure 5:
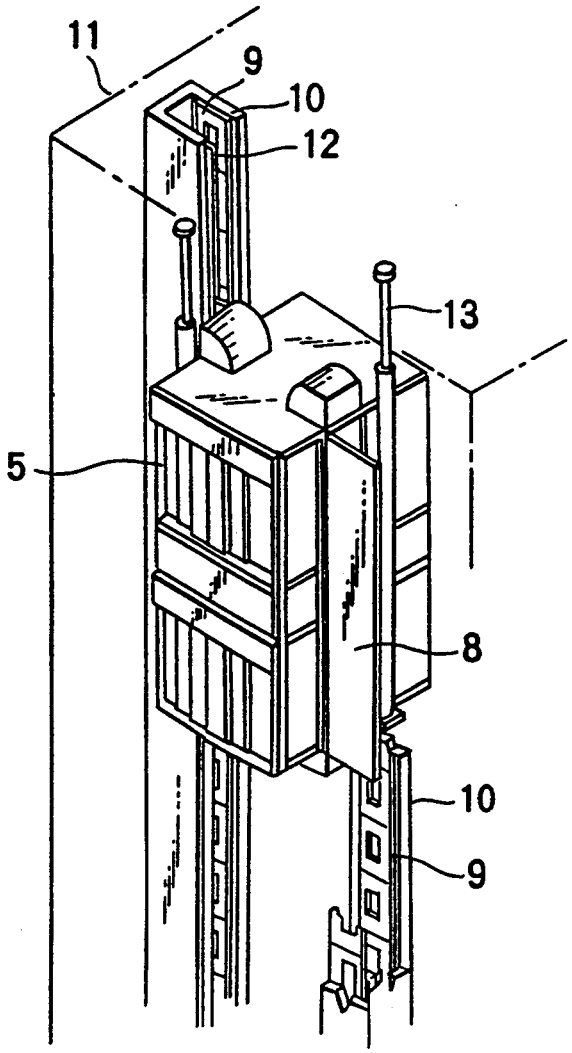
FIG. 5 PRIOR ART
FIG. 5 is a perspective view showing essential parts of a conventional ropeless elevator.
Figure 6:
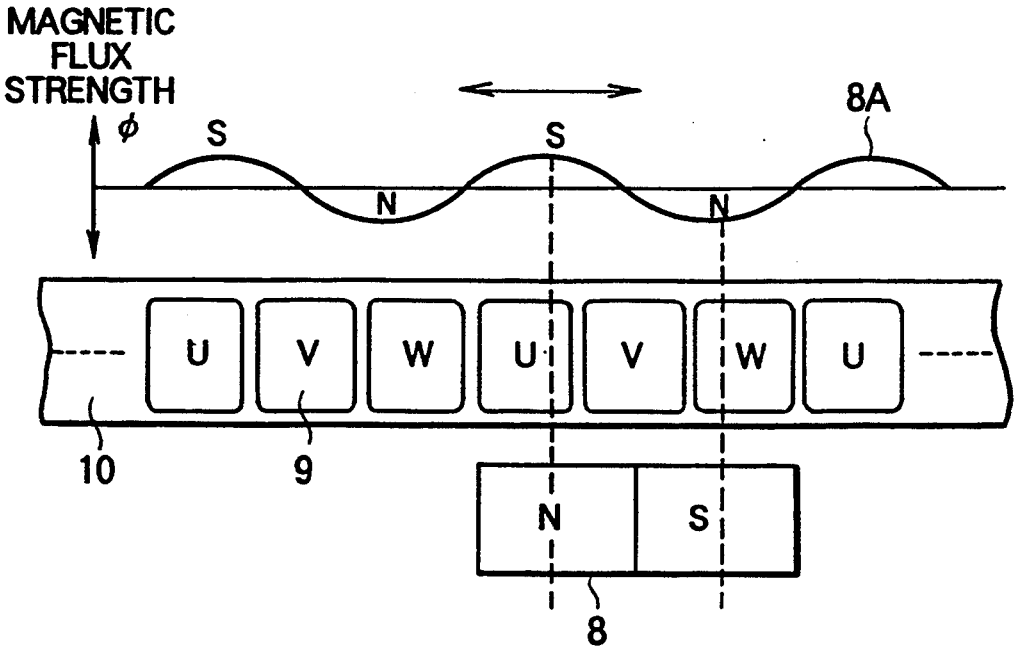
FIG. 6 PRIOR ART
FIG. 6 is a diagram illustrating the principle of a linear motor.
Figure 7:
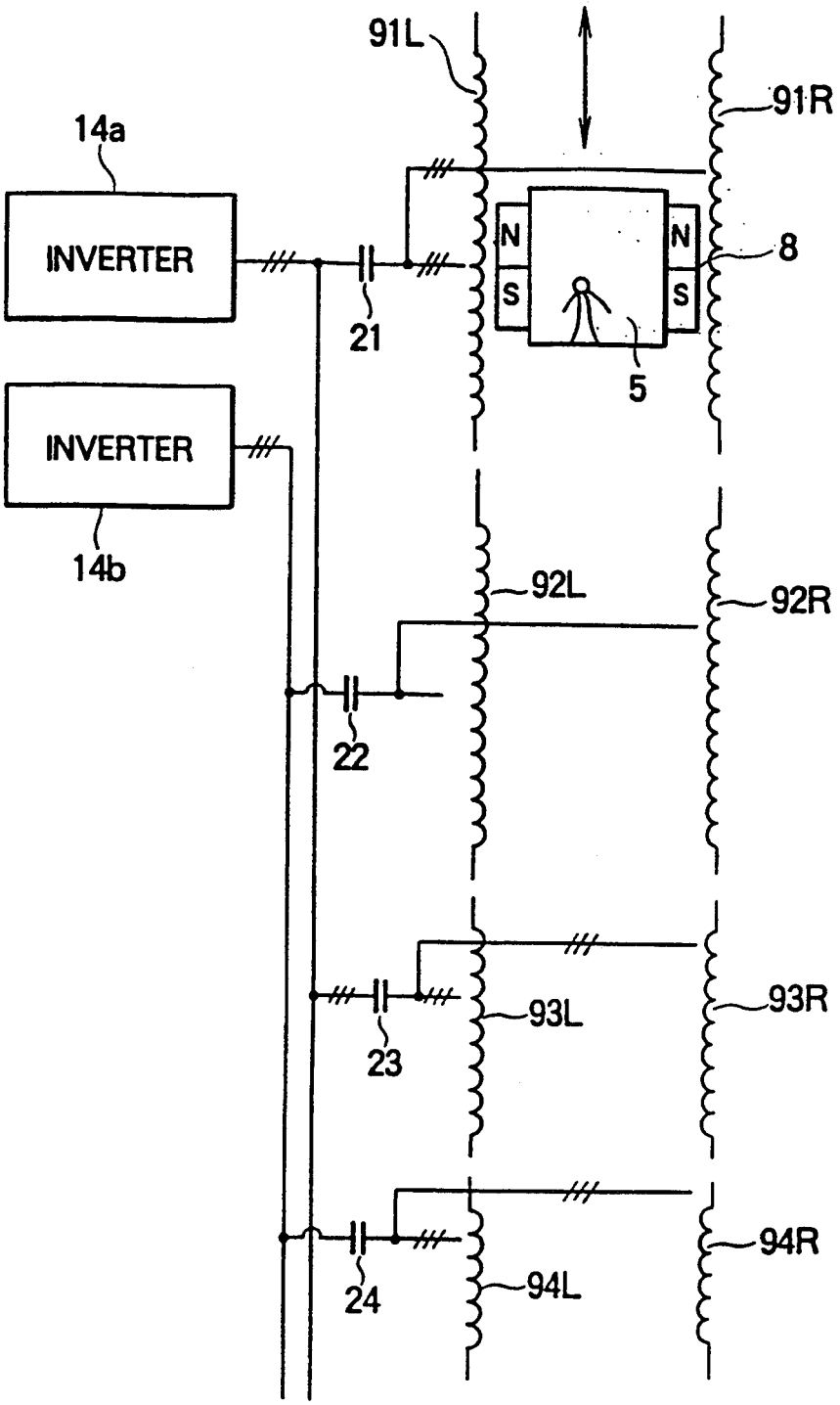
FIG. 7 PRIOR ART
FIG. 7 is a diagram showing a circuit for feeding the armature coil of a conventional ropeless elevator.
Figure 8:
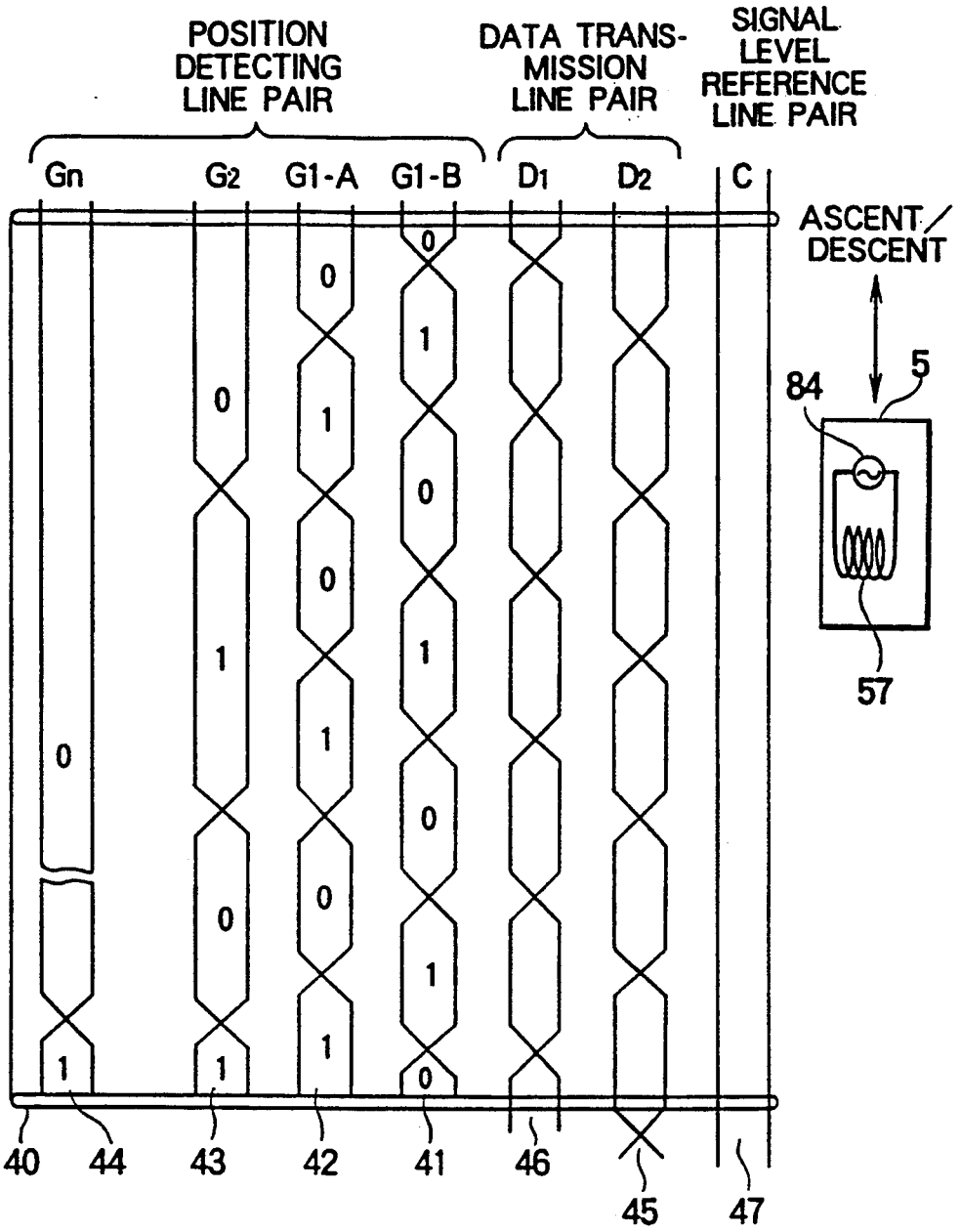
FIG. 8 PRIOR ART
FIG. 8 is a diagram for illustrating the operation of a cross induction line cable.
Figure 9:
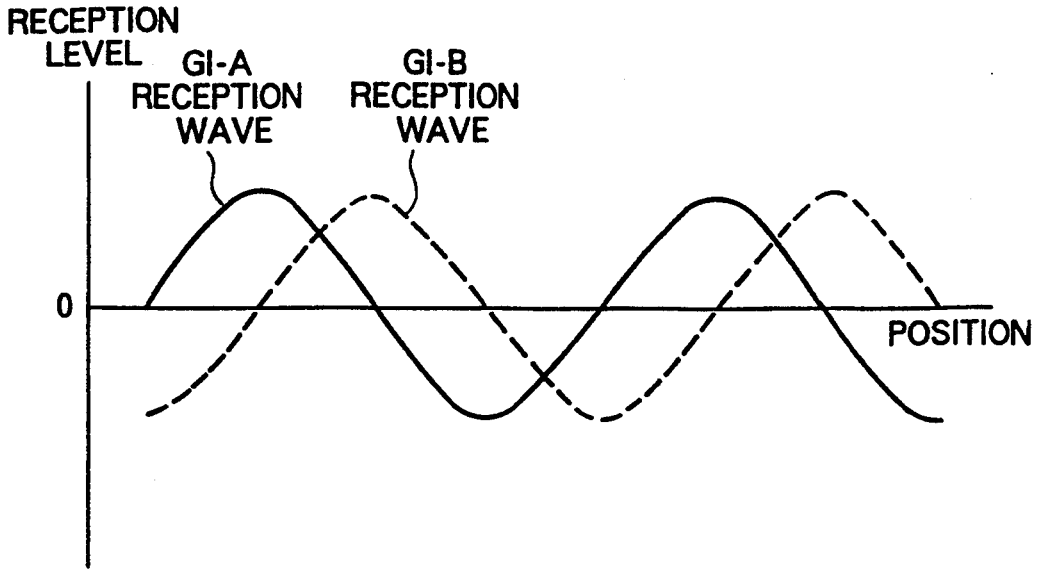
FIG. 9 PRIOR ART
FIG. 9 is a diagram showing the electromotive forces induced in the induction line cable of FIG. 8.

FIG. 3 shows a second embodiment of this invention, which is an improvement over the induction radio apparatus of FIG. 1. When performing data transmission from the elevator side to the building side of the apparatus of FIG. 1, it is necessary to transmit data on elevator speed and car position (i.e., field pole phase) serially with respect to signals indicating destination floor designation in the car 5, door opening/closing conditions, etc., resulting in a rather long transmission time. In the second embodiment, two carrier frequencies, f4 and f5, are added, and there is provided a dedicated line for transferring to the building side the field pole phase $\theta_1$ and the speed v, detected on the side of the car 5B.

The induction radio apparatus 54B of this second embodiment is formed by further equipping the induction radio apparatus 54A of the first embodiment, shown in FIG. 1, with a band-pass filter-detector circuit 90 for a dedicated line for speed transmission, a band-pass filter-detector circuit 91 for a dedicated line for car position (i.e., field pole phase) transmission, and data reception circuits 94 and 95 for receiving speed data and car position data respectively from the outputs of these band-pass filter-detector circuits 90 and 91 and supplying the data to the control circuit 54.

The car 5B is formed by further equipping the car 5 of the first embodiment with modulation circuits 92 and 93 for transmitting data on speed and car position to the building side. These modulation circuits 92 and 93 have carrier frequencies f4 and f5, respectively, and are connected between the position/speed detection circuit 62 and the antenna 57.

The speed v and the car position $\theta_1$ detected by the position/speed detection circuit 62 are transmitted constantly to the induction radio apparatus 54B in parallel with the transmission of data such as destination floor signals. The speed v and the car position $\theta_1$ are transmitted on their respective dedicated carrier frequencies, so that they are detected by the band-pass filter-detector circuits 90 and 91 in the induction radio apparatus 54B and received by the data reception circuits 94 and 95.

By thus providing, apart from the line from the car data, such as destination floor signals, dedicated lines with different carrier frequencies for constantly transmitting data on the speed and position (field pole phase) of the elevator, it is possible to form a control circuit for high-performance linear synchronization motors which involves less delay.

While the above embodiments have been described with reference to a system where the detector on the car 5 is of the type in which an encoder is rotated by bringing a roller into contact with the elevator rail, it is possible to attain a further improvement in reliability, etc., by adopting a non-contact-type detection system which utilizes a long-distance linear encoder, a laser beam or the like to recognize the image of a reflection pattern on the rail, performing positional detection from the amount of movement of the image, etc.

Further, while the inverter current control circuit has been described with reference to a three-phase AC comparison system, it is also possible to adopt system in which dq-axis conversion is effected to perform DC comparison.

What is claimed is:

1. A ropeless elevator controller for a ropeless elevator wherein a plurality of primary windings are arranged in an elevator hoistway on a building side of the hoistway and wherein a magnetic field generating device is provided on an elevator car side, the car being caused to ascend or descend by generating a shifting magnetic field in the primary windings through an inverter, said ropeless elevator controller comprising:

a cross induction line cable arranged along the elevator hoistway on the building side;

excitation means which is provided on the car side for generating sinusoidal waves for positional detection in said cross induction line cable;

movement amount detecting means which is provided on the car side for detecting an amount of movement of the car;

data calculating means which is provided on the car for calculating data on car speed and on a magnetic pole phase of the magnetic field generating device on the basis of the amount of movement detected by said movement amount detecting means;

data transmission means which is provided on the car and which utilizes said cross induction line cable for transmitting the data calculated by said data calculating means to the building side;

an induction radio circuit which is provided on the building side and which receives the data transmitted from said data transmission means by utilizing said cross induction line cable and calculates an initial phase of the magnetic field generating device provided on the car from the sinusoidal waves generated in said cross induction line cable; and an inverter control circuit which is provided on the building side and which interpolates the initial phase calculated by said induction radio circuit on the basis of the magnetic pole phase received by said induction radio circuit and controls the inverter on the basis of the interpolated phase and the data on car speed received by said induction radio circuit.

2. A controller according to claim 1 wherein said movement amount detecting means includes an encoder and a roller attached to said encoder and adapted to rotate said encoder by coming into contact with a rail arranged along the elevator hoistway on the building side.

3. A controller according to claim 1 wherein said excitation means and said data transmission means effect sinusoidal wave generation and data transmission on carrier frequencies which are different from each other.

4. A controller according to claim 1 wherein said inverter control circuit includes:

a speed command circuit for generating a car speed command value;

a deviation calculating circuit for calculating the deviation of the speed data, received by said induction radio circuit, from the speed command value generated by said speed command circuit; and a current command circuit which generates a current command value on the basis of the deviation calculated by said deviation calculating circuit and which obtains a value consisting of the sum of the initial phase and the magnetic pole phase as the phase of the current command value.

5. A controller according to claim 1 wherein said data transmission means transmits a destination floor signal generated in the car to the building side by utilizing said cross induction line cable, along with the data calculated by said data calculating means.

6. A controller according to claim 5 wherein said data transmission means includes first to third modulation circuits for transmitting said data on car speed, said data on magnetic field generating device magnetic pole phase, and said destination floor signal, individually on different carrier frequencies.

7. A controller according to claim 6 wherein said induction radio circuit includes first to third detector circuits respectively corresponding to the first to third modulation circuits of said data transmission means.

* * * * *

UNITED STATES PATENT AND TRADEMARK OFFICE

CERTIFICATE OF CORRECTION

PATENT NO. : 5,393,941

DATED : February 28, 1995

INVENTOR(S) : Mizuno et al.

It is certified that error appears in the above-indentified patent and that said Letters Patent is hereby corrected as shown below:

Column 7, Line 40, after "car" insert --side--;

Line 45, after "car" insert --side--.

Signed and Sealed this

Twenty-third Day of May, 1995

*Attest:*

Bruce Lehman

BRUCE LEHMAN

*Attesting Officer*

*Commissioner of Patents and Trademarks*